United States Patent [19]

Olson

[11] Patent Number: 4,511,311

[45] Date of Patent: Apr. 16, 1985

[54] FLUID SYSTEM CONTROL APPARATUS AND METHOD

[75] Inventor: John T. Olson, Edina, Minn.

[73] Assignee: Economics Laboratory, Inc., St. Paul, Minn.

[21] Appl. No.: 413,628

[22] Filed: Sep. 1, 1982

[51] Int. Cl.[3] ..... F04B 41/06

[52] U.S. Cl. ..... 417/5; 417/36

[58] Field of Search ..... 417/2–8, 417/36–40, 211.5, 53

[56] References Cited

U.S. PATENT DOCUMENTS

| | | | |
|---|---|---|---|
| 2,526,646 | 10/1950 | Ericson | 417/7 |
| 2,741,986 | 4/1956 | Smith | 103/11 |
| 2,797,846 | 7/1957 | Reed | 417/7 X |
| 3,005,411 | 10/1961 | Metz | 103/11 |
| 3,639,081 | 2/1972 | Gray et al. | 417/7 |
| 3,741,683 | 6/1973 | McTamaney et al. | 417/7 |
| 3,744,932 | 7/1973 | Prevett | 417/8 |
| 3,811,792 | 5/1974 | Kennedy, Jr. | 417/28 |
| 3,814,541 | 6/1974 | Dent et al. | 417/7 |
| 4,076,457 | 2/1978 | Skinner et al. | 417/53 X |

OTHER PUBLICATIONS

Klenzade Publication by Economics Laboratory, Inc., "Installation and Operation of Multi-Stage Central High Pressure Cleaning System".

*Primary Examiner*—Edward K. Look

*Attorney, Agent, or Firm*—Merchant, Gould, Smith, Edell, Welter & Schmidt

[57] ABSTRACT

A method and apparatus for controlling the amount of fluid (12) pumped to a using implement by a fluid distribution system (10) is the subject of this application. The apparatus includes a weir chamber (40) into which fluid diverted from a fluid supply line (22) into a return line (36) floods. A head is generated in the chamber (40), the height of the head depending upon the volumetric rate of residual flow through the return line (36). Sensing means (52, 54) are provided in the chamber (40) to sense the volumetric rate of flow of diverted fluid. The amount of fluid (12) pumped through the supply line (22) is controlled, in response to the head sensed in the weir chamber (40), by a controller unit (62) which governs operation of pumps (24) pumping fluid (12) through the supply line (22).

9 Claims, 3 Drawing Figures

FLUID SYSTEM CONTROL APPARATUS AND METHOD

TECHNICAL FIELD

The invention of the present application is directed broadly to fluid distribution and delivery systems. More specifically, it is directed to an apparatus and method for use with a system wherein fluid in a reservoir is pumped by a plurality of pumps through a supply line and a regulator to an implement using the fluid, and wherein the regulator diverts supplied fluid not demanded by the implement back to the reservoir. The preferred embodiment of the invention contemplates an apparatus and method for varying the amount of fluid pumped from the reservoir in response to the demands imposed by the implement.

BACKGROUND OF THE INVENTION

Numerous applications exist for fluid, and specifically liquid, supply systems wherein the fluid is distributed through a manifold having a plurality of outlet stations. Illustrative of such an application is a system of the type utilized in meat slaughter and packing houses. At various stages during meat processing, cleaning guns, to which a liquid is supplied, are provided. The system provides automatically controlled high-pressure hot water or other fluids for distribution throughout the plant through fixed headers to actual use points. The guns, or wands, can be used for general spray-down, cleaning and rinsing.

Because of the plurality of stations which are provided, the demand created by the overall manifold system can vary significantly. Typically, a plurality of pumps are provided to pump the cleaning liquid from the reservoir in which it is stored to the various stations. With some prior structures, pumps having a sufficient aggregate capacity to provide the maximum demand of liquid are provided and are kept on line at all times during operation of the plant. With these structures, there is always some measure of waste in energy expended in moving fluid through a supply line to the manifold. When the demand created by the various stations is high, the actual waste of energy expended will be relatively low. The consumption of fuel in running all of the pumps will be at a maximum, but, because of the high demand, the expenditure of fuel in running the pumps can be justified.

On the other hand, however, when the demand is relatively low, a greater number of pumps than necessary to satisfy the demand will be running. Under such circumstances, the additional energy expended in running the unnecessary pumps is wasted.

Various systems have been devised to automatically bring on-line and cut off-line additional pumps, as necessary, in response to the actual demand created by the manifold stations. Such systems have, heretofore, however, been responsive to pressures or pressure drops sensed within the system. Illustrative of such a system is that disclosed in U.S. Pat. No. 3,639,081 issued to John Gray and Gene W. Anderson on Feb. 1, 1972. All other systems of which applicant is aware function in response to sensing of pressures and pressure increases and drops.

Such systems, however, have some inherent deficiencies. The accuracy of such systems is completely dependent upon the correct sensing by, and the calibration of, the various sensing instruments. Additionally, changes in the number of pumps on line are not particularly responsive to the actual demand since there is a time lag between the reduced demand and the sensing of a reduced pressure in the system.

It is to these deficiencies in prior art systems that the invention of the present application is directed. The present invention provides means for increasing and decreasing the number of pumps on line without the shortcomings inherent in these prior art systems.

SUMMARY OF THE INVENTION

The present invention includes a method for controlling the amount of fluid pumped to a using implement such as a multi-station manifold system, from a reservoir and through a fluid distribution line., A first step of the method involves diverting fluid not actually demanded by the manifold back to a reservoir from which the fluid has been pumped. The volumetric rate of flow of this fluid is sensed, and the volume of fluid flow is increased or decreased in response to the volume of fluid returned per unit time. As the amount of fluid returned increases, less fluid is pumped from the reservoir through the supply line.

The method can be accomplished by using pumps which are selectively actuated and deactuated in order to increase and decrease, respectively, the amount of fluid pumped into the supply line. The steps for actuating and deactuating the pumps can be controlled automatically in accordance with the functions of a controller unit.

The invention further includes apparatus for effectuating the method invention. The apparatus includes means for measuring the volumetric rate of flow of fluid which is diverted, for example, by a regulator in the supply line. The apparatus invention, additionally, includes means, responsive to the sensed volumetric rate of fluid flow diverted, for actuating additional pumps whenever the diverted flow is less than a first designated quantity. Further, means, responsive to the sensed diverted flow, are incorporated for deactivating pumps whenever the diverted flow exceeds a second designated quantity.

In a preferred embodiment of the invention, the means for measuring volumetric rate of flow of the liquid diverted by the regulator can include a chamber having a generally vertically elongated slit formed in a side wall thereof. The diverted flow is fed into the chamber through an inlet port passing through a bottom wall of the chamber. A first probe is disposed within the chamber to extend generally vertically with a bottom end thereof positioned so that, when it becomes immersed in diverted fluid rising within the chamber and exiting through the slit, it will sense that at least a minimum number of pumps necessary to provide a minimum desired return flow are on line. A second probe, similar in structure and disposition to the first, can be monted in the chamber with its lower end positioned to sense, when its lower end becomes immersed in diverted flow returning into the chamber, that a more than necessary number of pumps are on line.

Preferrably, the pumps are connected in parallel and are of equal capacity. A pump can, therefore, be brought on line or deactivated, as the case may be, without it being necessary that one specific pump be the pump brought on line or deactivated.

The invention of the present application is, therefore, an improved method and apparatus for solving the problems in the prior art. More specific advantages of the invention will become apparent with reference to the DETAILED DESCRIPTION OF THE INVENTION portion of this application, the claims, and the accompanying drawings.

DETAILED DESCRIPTION

Figure 1:
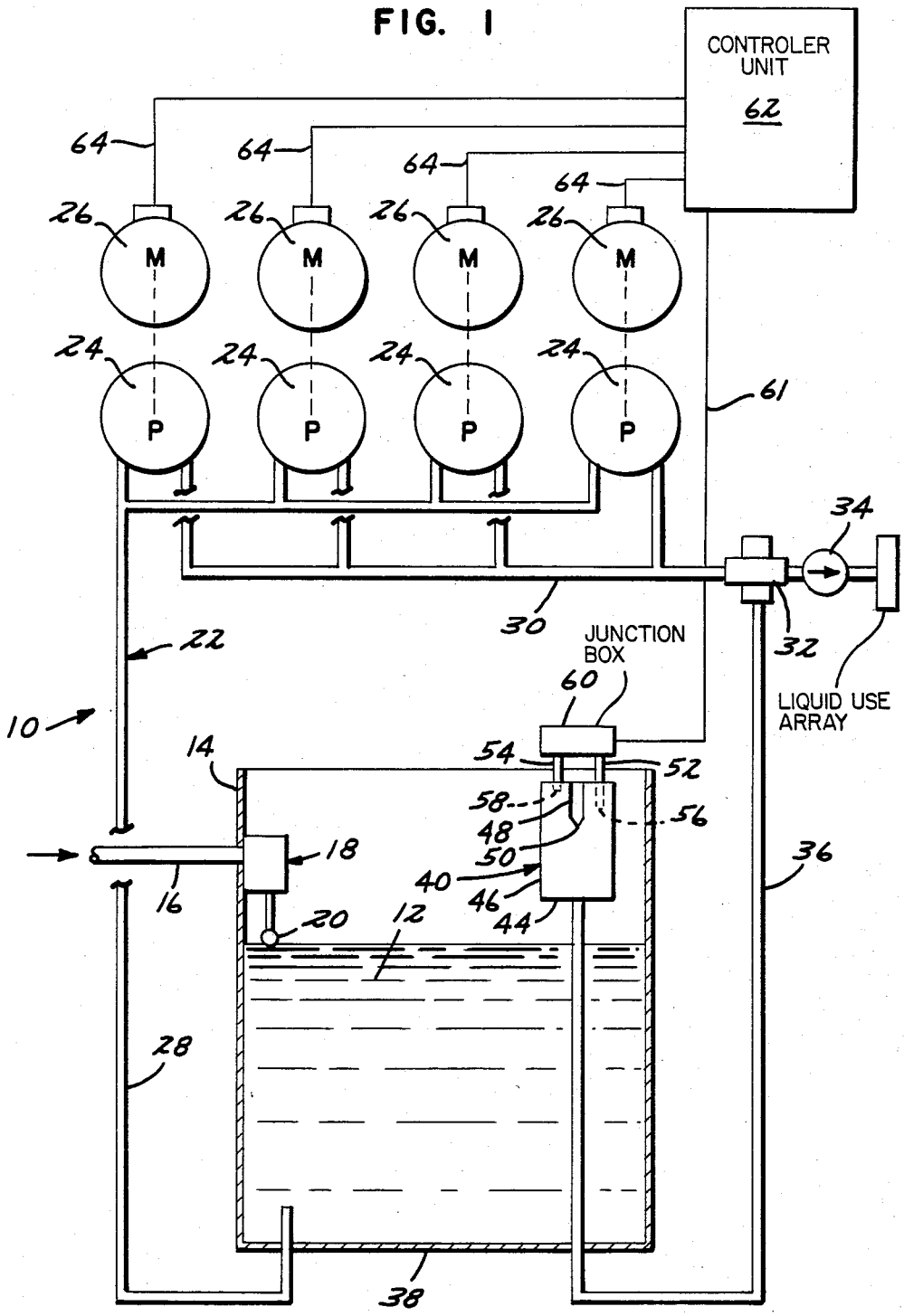
FIG. 1 is a schematic view illustrating the invention in combination with a fluid distribution system with which it can be used.

Referring now to the drawings wherein like reference numerals denote like elements throughout the several views, FIG. 1 illustrates schematically an overall fluid distribution system 10 in which the invention of the present application is used. In one particular application, the system 10 is used to deliver a liquid, such as hot water or other cleaning solution, to a distribution manifold (not shown) having a plurality of cleaning stations. Typically such an application would function in a meat or food packaging plant whereing a plurality of cleaning guns or wands are used to clean at various stages during processing.

The distribution manifold is supplied with fluid 12 held in a reservoir 14. The reservoir 14 is supplied by an incoming line 16, and the level of fluid 12 within the reservoir 14 can be controlled by appropriate means such as a float switch 18 having a float sensor 20 for ascertaining the height of the liquid 12 within the reservoir 14. If the float sensor 20 sensed the rising of the level within the reservoir tank 14 to a level above which it is desired that the liquid not rise, automatic means, such as a solenoid valve (not shown), could be actuated to preclude further entry of fluid 12 into the tank 14.

Fluid 12 in the tank 14 is channeled to the distribution manifold through a fluid supply or delivery line 22. A plurality of pumps 24, each actuable by its own driving motor 26, are interposed in the supply line 22. The supply line 22 is, thereby, divided into a first portion 28 up-flow of the pumps 24 and a second portion 30 down-flow of the pumps 24. At any particular time one or more of the pumps 24 may be actuated in order to move fluid 12 from the tank 14 to the distribution manifold or other implement demanding fluid from the source. In a preferred embodiment of the invention, the pumps 24 can be connected in parallel so that pumps 24 not actuated do not impede flow of the fluid through the supply line 22.

A flow regulator 32 can be interposed in the supply line 22 intermediate the plurality of pumps 24 and the user implement. In various of the applications to which the distribution system 10 can be put, the demand created by the user implement will vary depending upon the circumstances. This is particularly true when the implement is a distribution manifold as previously discussed. Fluid may be discharged at any number of a multiplicity of stations along the manifold at any particular point in time. As discharge is effected at additional stations, the demand created by the manifold will increase. Conversely, as discharge is discontinued at an increasing number of stations, the demand created by the manifold will decrease. The regulator 32 is interposed in the supply line 30 in order to channel an amount of fluid 12 demanded by the user implement to the implement, and to divert any fluid 12 flow from the reservoir 14 which is not demanded by the implement back to the reservoir 14. One example of a flow regulator 32 is that of an FMC Regulator Model No. 5257600. F.M.C. Corporation's Agricultural Machinery Division, where this regulator is available, is located at 5601 East Highland Drive, Jonesboro, Ark. 72401. The regulator from F.M.C. has three ports and functions in the manner described in this specification for the regulator 32.

A check valve 34 can be positioned in the supply line 22 at a location down-flow from the regulator 32. By positioning a check valve 34 in this manner, flow will be precluded back through the regulator 32 once it has been allowed to flow through to the distribution manifold.

The flow which is diverted by the regulator 32 passes through a fluid return line 36. This line 36 is shown as extending upwardly through the bottom 38 of the reservoir 14 and to a height above the height at which the level of fluid in the reservoir 14 is maintained.

The return line 36 enters a weir chamber 40 through an inlet port 42 formed in a bottom wall 44 thereof. Residual fluid diverted from the supply line 22 by the regulator 32 floods the weir chamber 40 through the inlet port 42. A sidewall 46 of the chamber 40 has an aperture, illustrated as a generally vertically extending slit 48 in FIG. 1, formed therein. As the chamber 40 is flooded by the residual fluid, the fluid, when it reaches the lowermost extremity 50 of the slit 48, will spill over and, when the weir chamber 40 is within the reservoir 14, into the reservoir 14 itself.

The level to which the residual fluid will rise within the weir chamber 40 is a function of the volumetric rate of flow of the diverted flow. As the chamber 40 fills with fluid, it begins to flow out of the slit 48. For any given flow, the level within the chamber 40 will stabilize at a corresponding head. Low flow corresponds to a low head and, in turn, a low volumetric rate of return flow. In contrast, a high flow corresponds to a high head, and, in turn, a large volumetric rate of return flow. As can be seen, therefore, return flow is transformed into a particular head depending upon the volumetric rate of return fluid flow.

Figure 2:
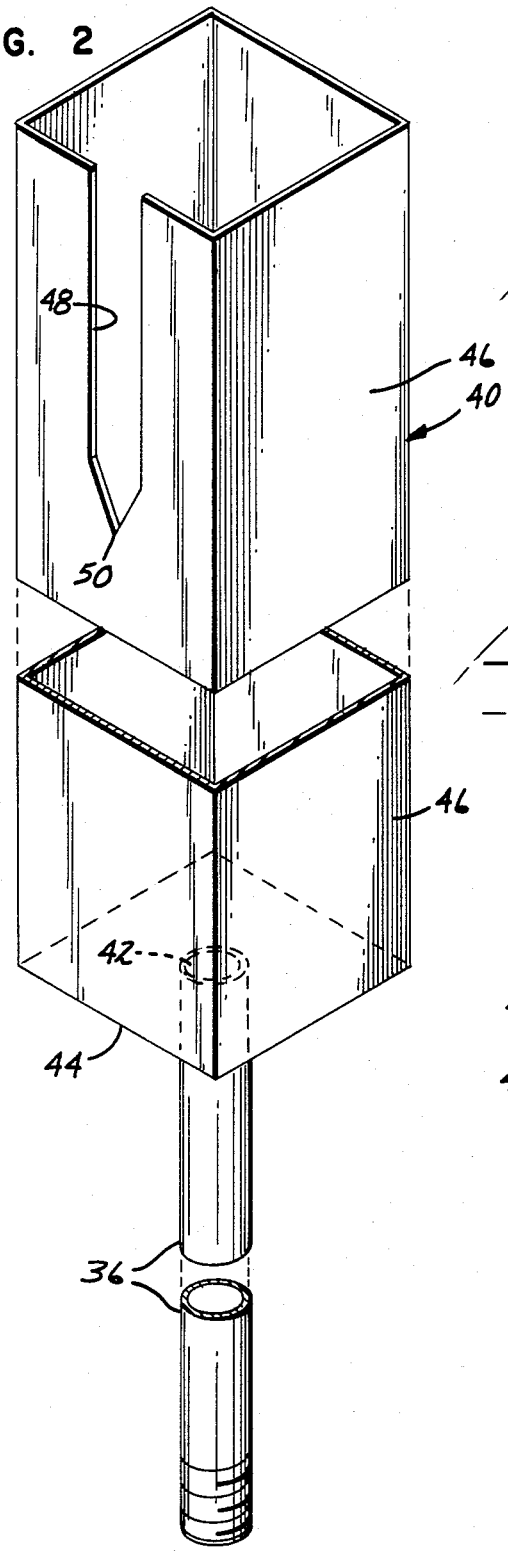
FIG. 2 is an enlarged perspective view of a weir chamber in accordance with the invention of the present application, some portions thereof broken away.
Figure 3:
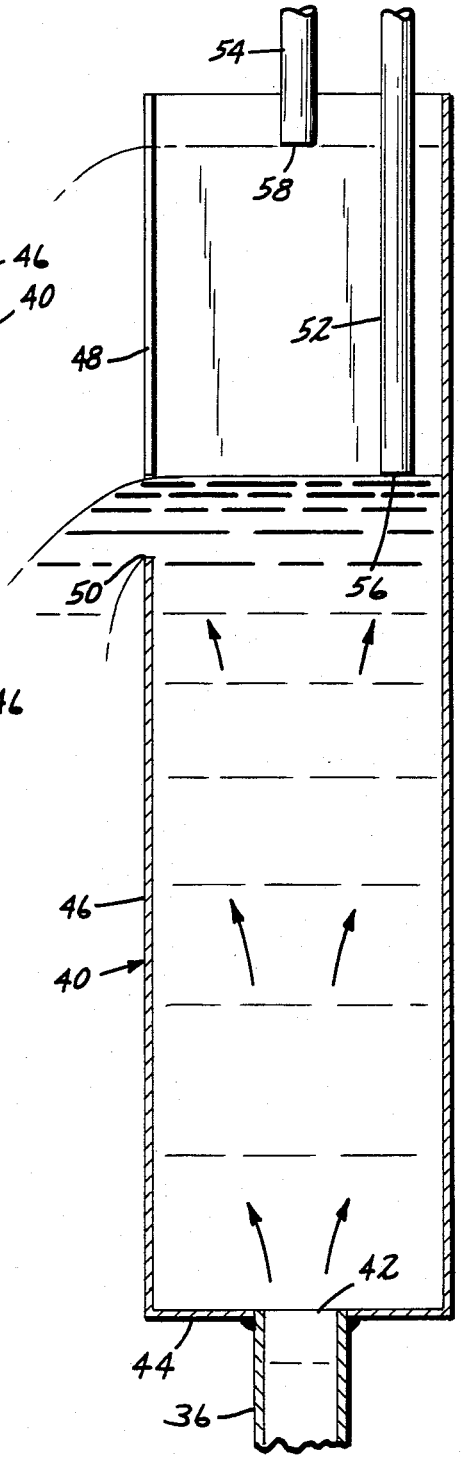
FIG. 3 is a side sectional view of the weir chamber of FIG. 2, illustrating the relative positioning of volumetric rate of flow sensing probes.

Referring then to FIGS. 2 and 3 for a more detailed illustration of the weir chamber 40 and other features of the invention, FIG. 3 illustrates a pair of probes 52, 54 disposed within the chamber 40. A first, or low level, probe 52 is seen as being disposed along the slit 48 with its lower end 56 positioned slightly above the lowermost extremity 50 of the slit 48.

It will be seen that if there is no flow through the return line 36, no fluid will pass through the slit 48 in the weir chamber 40. As return flow is generated as a result of the amount of fluid being pumped through the supply line 22 exceeding the demand created by the manifold, the height along the slit 48 to which the fluid rises will increase as the differential between the fluid supplied to the regulator 32 and the demand created by the manifold increases.

In order to insure that enough fluid is always being pumped in order to satisfy the demand of the using implement, it is desirable that there always be at least a minimal return flow. The first probe 52 functions to effect this purpose. It is positioned within the weir chamber 40 with its lower extremity 56 slightly above the lowermost extremity 50 of the slit 48. As will be discussed hereinafter, when the first probe 52 does not sense a head of fluid within the weir chamber 50, additional pumps 24 will be actuated in order to generate additional flow within the supply line 22.

The distance at which the lower extremity 56 of the probe 52 is positioned above the lower extremity 50 of the slit 48 is an arbitrary distance, but one small enough to minimize the energy wasted by the generation of a large backflow through the return line 36. This will, of course, be a function of the capacities of the pumps 24 which are interposed in the supply line 22. In a preferred embodiment, four 10 gallon per minute pumps 24 are used. With pumps 24 so sized, it has been determined that it is desirable to have a backflow of two gallons per minute before the head of fluid within the weir chamber 40 rises sufficiently so that the fluid is sensed by the first probe 52.

A second probe 54 is also disposed within the weir chamber 40. The lower extremity 58 of the second probe 54 is positioned at a height above the height at which the lower extremity 56 of the first probe 52 is disposed. It is the function of the second probe 54 to sense a large backflow representative of wasted pumping energy. When the backflow generates a head within the weir chamber 40 so that the head is sensed by the second probe 54, a pump or pumps 24 interposed in the supply line 22 will be sequenced off in order to decrease the amount of fluid flow to the regulator 32.

In order to simplify operations, it is desirable that all the pumps 24 in the system 10 be of the same capacity. It is desirable that the differential in volumetric rates of fluid flow represented by the various heads sensed by the probes 52, 54 be greater than the capacity of one of these pumps 24. Otherwise, conceivably, the system 10 could achieve an oscillating condition wherein, as a pump 24 were kicked on line because of the first probe 52 failing to sense the rising of the head within the weir chamber 40 to a lower extremity 56 thereof, the head would rise to a point at which the lower extremity 58 of the second probe 54 sensed a head. The pump 24 which had just sequenced on, therefore, would be immediately sequenced off. The level of fluid within the weir chamber 40 would, thereby, drop to a level at which the first probe 52 would not sense a head. Such oscillation would continue as long as the demand generated by the using implement remained the same.

Referring again to FIG. 1, leads (not shown) from the probes 52, 54 extend to a junction box 60 which, in turn, communicates, through appropriate means 61, with means for activating and deactivating the various pumps 24. The pump sequencing means can be a controller unit 62 from which the activation/deactivation signals are transmitted, through cables 64, to the motors 26 by which the pumps 24 are run. The controller/-pump timing unit 62 can be of one of a number of types known in the art. One example of a controller unit 62 that is currently available and may be used is Leeds and Northrup 1300 Process Programmer. Leeds and Northrup Company is located at North Wales, Pa. 19454. The 1300 Process Programmer may be programmed to perform the functions as detailed in this specification.

OPERATION

For purposes of describing the operation of the distribution system 10 in which the invention is used, it will be assumed that all pumps 24 have a similar capacity. Further, it will be assumed that that capacity is ten gallons per minute.

Assuming that it is desired to commence operation of the distribution system 10 when it is in a shut-down mode, initiation of actuation of pumps 24 to move fluid 12 from the reservoir tank 14 through the regulator 32 occurs when a demand is created for fluid 12 at at least one of the cleaning gun stations. If a demand for thirteen gallons per minute is generated by the distribution manifold, and there initially is no flow through the supply line 22, there will, of course, be no backflow through the return line 36 and, consequently, no residual fluid return flow will be sensed by the first probe 52. A signal will be transmitted from the junction box 60 to the controller unit 62, and a first motor 26 will be actuated to drive one of the pumps 24. Ten gallons per minute of fluid will, therefore, be pumped through the supply line 22 to the regulator 32.

If the demand for thirteen gallons per minute persists, however, for, for example, three seconds after actuation of the first pump 24, a threshhold backflow of two gallons per minute as required for the first probe 52 to sense a backflow is not achieved. After the three second interval, therefore, a second motor 26 will be activated by the controller unit 62 to bring a second pump 24 on line. The volumetric rate of flow through the supply line 22 will be twenty gallons per minute after the second pump 24 is brought up.

Since a demand of only thirteen gallons per minute is required by the distribution manifold, the regulator 32 will divert seven gallons per minute back to the reservoir 14 through the return line 36. Since the head of fluid generated within the weir chamber 40 corresponding to a backflow of seven gallons per minute exceeds the two gallon per minute threshhold required for the first probe 52 to sense a backflow, the first probe 52 will sense the flooding of the weir chamber 40 and no signal will be transmitted to the controller unit 62 indicating that any further pumps 24 need be brought up on line.

Should the demand at this point be reduced to, for example, six gallons per minute, fourteen gallons per minute will be diverted by the regulator 32 into the return line 36. If the second probe 54 is positioned to sense a head of fluid corresponding to a backflow of thirteen gallons per minute or more, backflow will be sensed by the second probe 54, and a signal will be sent by the junction box 60 to the controller unit 62 directing the deactuation of one of the pumps 24 on line. At this point in the operation of the system 10, ten gallons per minute will be pumped with six of those gallons going to the distribution manifold and four returning to the reservoir 14 through the return line 36 and weir chamber 40.

If at this point the demand increases significantly to twenty-six gallons per minute, no backflow will be generated until two additional pumps 24 are brought on line at three second intervals. Once the system 10 is operating with three pumps 24 generating movement of thirty gallons per minute through the supply line 22, assuming a constant demand of twenty-six gallons per minute, four gallons per minute will return to the reservoir 14 through the return line 36 and weir chamber 40. As can be seen, as long as the volumetric rate of flow through the return line 36 and weir chamber 40 into the reservoir tank 14 exceeds the threshhold amount of two gallons per minute, a signal actuating an additional pump or pumps 24 will not be generated. Similarly, as long as the return flow does not exceed thirteen gallons per minute, a signal causing deactuation of pumps 24 will not be initiated by the second probe 54. It will be seen, therefore, that, with three pumps 24 on line, the demand can vary anywhere between seventeen gallons per minute and twenty-eight gallons per minute without any change in pump status being initiated.

Should the demand, however, increase to twenty-nine gallons per minute, the backflow will not achieve the minimum two gallon per minute threshhold so that the first probe 52 will sense backflow. A fourth pump 24 will, therefore, be actuated generating a flow of forty gallons per minute through the supply line 22. With the demand remaining constant at twenty-nine gallons per minute, the backflow will be eleven gallons per minute, and the pump status will not change. If the demand should reduce to seven gallons per minute, however, the backflow will be thirty-three gallons per minute and both the first and second probes 52, 54 will be immersed in the fluid 12 within the weir chamber 40. Consequently, a first pump 24 will be shut down so that only thirty gallons per minute will be pumped through the supply line 22 to the regulator 32. With a seven gallon per minute demand, however, the backflow will still be at twenty-three gallons per minute, and both probes 52, 54 will remain immersed in the fluid flooding the weir chamber 40. A second pump 24 will, therefore, be shut down.

Assuming the demand still remains constant at seven gallons per minute, the backflow in the weir chamber will be at thirteen gallons per minute. The second probe 54 will, therefore, still sense the backflow and a third pump 24 will be shut down, thereby reducing the flow through the supply line 22 to ten gallons per minute and the residual return flow through the weir chamber 40 to three gallons per minute. At this stage, the system 10 will have reached equilibrium with pumps 24 neither being necessarily activated nor deactivated in order to provide a backflow sensed by only the first probe 52.

The following chart illustrates the sequences discussed herein:

| pumped | demand | backflow |
|---|---|---|
| 10 | 13 | — |
| 20 | 13 | 7 |
| 20 | 6 | 14 |
| 10 | 6 | 4 |
| 20 | 26 | — |
| 30 | 26 | 4 |
| 30 | 25 | 5 |
| 30 | 28 | 2 |
| 30 | 29 | 1 |
| 40 | 29 | 11 |
| 40 | 7 | 33 |
| 30 | 7 | 23 |
| 20 | 7 | 13 |
| 10 | 7 | 3 |

As is apparent, should the demand be, for example, seven gallons per minute, only one pump 24 will be on line, and the residual flow through the return line 36 will be three gallons per minute. If all demand ceases, ten gallons per minute will be diverted by the regulator 32 into the return line 36. Ten gallons per minute is not, however, enough of a backflow to generate a head sufficient to allow the second probe 54 to sense the backflow. Consequently, the final pump 24 will not be deactivated even though there is no demand whatsoever. In order to preclude occurrence of this situation, means can be incorporated in the controller unit for periodically deactivating the pump 24 when only one pump 24 is on line. If a demand does, in fact, exist, a pump 24 will, again, be reactivated to satisfy the demand generated by the distribution manifold.

Numerous characteristics and advantages of the invention have been set forth in the foregoing description. It will be understood, of course, that this disclosure is in many respects, only illustrative. Changes may be made in details, particularly in matters of shape, size, and arrangement of parts without exceeding the scope of the invention. The invention's scope is defined by the language in which the appended claims are expressed.

What is claimed is:

1. In combination with a fluid distribution system including a reservoir containing a supply of fluid, a fluid supply line conveying fluid from the reservoir to an implement using the fluid at a variable rate, a plurality of pumps for moving fluid through the supply line, a flow regulator interposed in the supply line to control the amount of fluid delivered to the implement, and a fluid return line channeling fluid diverted from the supply line by the regulator back to the reservoir; apparatus for governing flow of fluid from the reservoir through the supply line, comprising:

(a) means for measuring volumetric rate of flow of fluid through the return line, said measuring means comprising:

(i) a weir chamber having an aperture with a vertical dimension formed in a side thereof;

(ii) means for conducting fluid in the return line into said chamber, the fluid entering said chamber below a lower extremity of said aperture and rising to a height within said chamber depending upon the volumetric rate of fluid flow in the return line;

(iii) first sensing means disposed for perceiving rising of fluid along said vertical dimension of said aperture to a first height corresponding to the quantity of fluid exceeding that minimum quantity needed by the implement by said first designated amount; and (iv) second sensing means disposed for perceiving rising of fluid along said vertical dimension of said aperture to a height corresponding to the quantity of fluid exceeding that minimum quantity needed by the implement by said second designated amount; and (b) means, responsive to the measured volumetric rate of fluid flow through the return line, for activating at least one additional pump, as necessary, in order to provide at least a quantity of fluid exceeding a minimum quantity needed by the implement by a first designated amount, to the regulator, and for deactivating at least one pump, as necessary, when the amount of fluid delivered to the regulator exceeds the minimum amount of fluid needed by the implement by a second designated amount.

2. The combination of claim 1 wherein said first and second sensing means comprise first and second liquid sensing probes.

3. The combination of claim 1 wherein said pump activation/deactivation means includes means for sequencing pumps on line when said first sensing means has not perceived rising of fluid within said weir chamber to said first height, and means for sequencing pumps off line when said second sensing means has perceived rising of fluid within said weir chamber to said second height.

4. The combination of claim 1 wherein said weir chamber is disposed within the reservoir and at a height above a height at which the level of fluid within the reservoir is maintained, wherein fluid passing through said aperture as the level within said chamber rises will drain into the reservoir.

5. The combination of claim 4 wherein said aperture comprises a generally vertically elongated slit.

6. A liquid distribution system for supplying liquid to a liquid use array, comprising:

(a) a reservoir holding a quantity of liquid;

(b) a delivery line communicating, at a first end thereof, with said reservoir and, at a second end thereof, with the array;

(c) a plurality of individually actuable pumps connected in said delivery line to pump liquid to the array;

(d) a regulator interposed in said delivery line intermediate said pumps and the array, said regulator allowing passage therethrough of a volume of liquid demanded by the array and diverting a residual amount of liquid back to said reservoir;

(e) a device disposed in said reservoir for sensing volumetric rates of liquid flow, said residual amount of liquid being channeled to said sensing device, said sensing device comprising:

(i) a weir chamber having a side wall, an aperture formed in said side wall, a bottom wall, and an inlet port in said bottom wall;

(ii) a first probe disposed in said chamber to perceive rising of liquid in said chamber, as it is flooded through said inlet port, to a first height corresponding to said first designated amount of residual liquid flow; and (iii) a second probe disposed in said chamber to perceive rising of liquid in said chamber to a second height corresponding to said second designated amount of residual liquid flow; and (f) means, responsive to the volumetric rate of residual liquid flow sensed by said device, for activating at least one of said pumps when the volumetric rate of residual liquid flow is less than a first designated amount, and for deactivating at least one of said pumps when the volumetric rate of residual liquid flow is greater than a second designated amount.

7. The system in accordance with claim 6 further comprising means for maintaining the level of liquid in said reservoir below the height at which said sensing device is disposed.

8. The system in accordance with claim 6 wherein each of said plurality of pumps has essentially the same pumping capacity.

9. The system in accordance with claim 6 or 8 wherein said plurality of pumps are connected in parallel.

* * * * *